United States Patent [19]

Duchateau et al.

[11] Patent Number: 4,739,975

[45] Date of Patent: Apr. 26, 1988

[54] CONTINUOUS CASTING DEVICE

[75] Inventors: Jean-Louis Duchateau, Jouy-en-Josas; Michel Mangin, Seremange; Patrick Bardet, Metz, all of France

[73] Assignee: Foseco International Limited, Birmingham, England

[21] Appl. No.: 926,727

[22] Filed: Nov. 4, 1986

[30] Foreign Application Priority Data

Nov. 5, 1985 [GB] United Kingdom ..... 8527264

[51] Int. Cl.[4] ..... C21C 7/00

[52] U.S. Cl. ..... 266/216; 266/44; 266/287

[58] Field of Search ..... 266/287, 210, 208, 227, 266/238, 216, 200, 236, 44

[56] References Cited

U.S. PATENT DOCUMENTS

| | | | |
|---|---|---|---|
| 2,929,704 | 3/1960 | Harders | 266/210 |
| 2,967,768 | 1/1961 | Harders | 266/210 |
| 3,314,669 | 4/1967 | Knüppel et al. | 266/210 |
| 3,663,204 | 5/1972 | Jungwirth | 266/210 |
| 3,776,534 | 12/1973 | Cashdollar, Sr. | 266/210 |

FOREIGN PATENT DOCUMENTS

| | | |
|---|---|---|
| 2121530 | 12/1971 | France . |
| 57-124559 | 3/1982 | Japan . |

*Primary Examiner*—L. Dewayne Rutledge
*Assistant Examiner*—S. Kastler
*Attorney, Agent, or Firm*—Nixon & Vanderhye

[57] ABSTRACT

A continuous casting device comprises a hollow body having one or more side walls and a heat-destructible base portion having one or more inclined surfaces. The device is for location beneath a ladle nozzle through which a tundish is to be supplied with molten metal e.g. steel. When the device is lowered through a layer of slag floating on the surface of the metal in the tundish the slag is deflected away from the base of the device. In this way a substantially slag free zone is provided into which molten metal may pass from a ladle into a tundish virtually free from contamination.

25 Claims, 1 Drawing Sheet

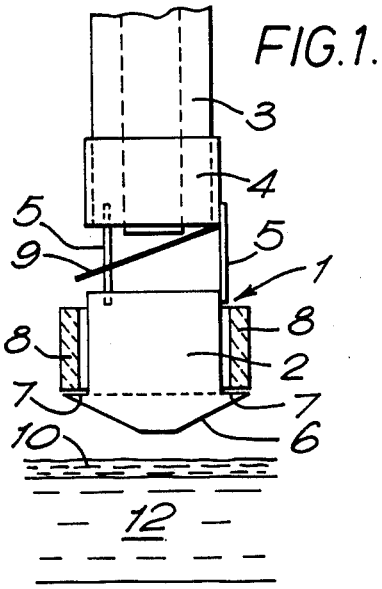
FIG. 1.
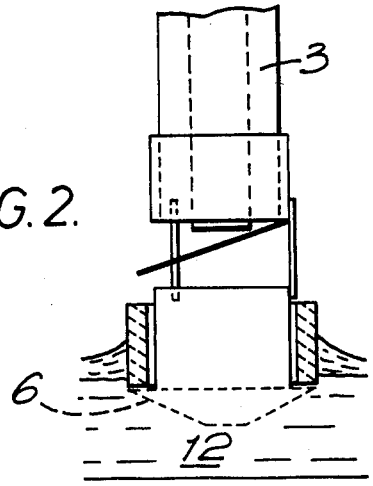
FIG. 2.
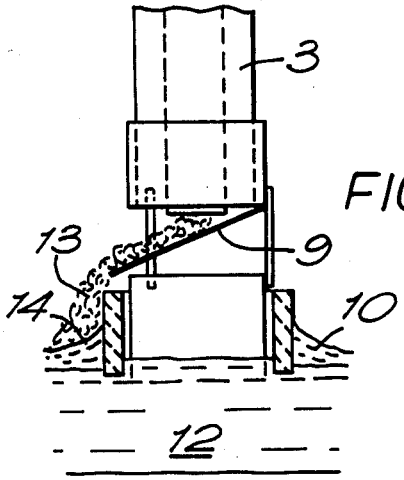
FIG. 3.
FIG. 4.
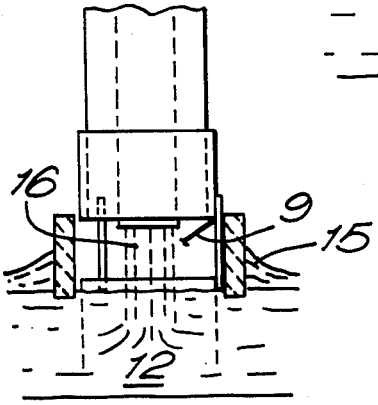
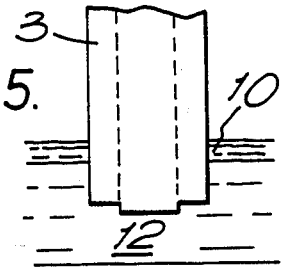
FIG. 5.

CONTINUOUS CASTING DEVICE

This invention relates to a continuous casting device and to a method of continuous casting using the device.

In continuous casting, molten metal e.g. steel is passed from a ladle into a tundish which serves to maintain a constant head of molten metal. The metal flows out from the base of the ladle into the tundish via a nozzle and from the tundish into one or more continuous casting moulds via one or more nozzles in the base of the tundish. Preferably, the metal is discharged from the ladle into the tundish via a pouring tube which serves to protect the metal stream from atomospheric oxidation which otherwise may give rise to oxide and other non-metallic inclusions which adversely affect the quality of the subsequent metal withdrawn from a continuous casting chill mould. However another source of undesirable inclusions in the metal withdrawn from the mould applies each time a new ladle is brought into use (during a sequential cast a number of ladlefuls of metal are sequentially poured into the tundish). The ladle nozzle generally contains an anti-skulling additive such as a particulate refractory material e.g. silica, alumina, chromite or the like which promotes easy start up of teeming when the nozzle is opened. Unfortunately, the anti-skull material falls into the tundish when the nozzle is opened. Generally, the nozzle of each new ladle is opened before the discharge end of the pouring tube is immersed into the molten metal in the tundish. Therefore, the first stream of metal coming from the new ladle forces the anti-skulling material and, the slag floating on the surface of the metal in the tundish, into the interior of the tundish metal which is thereby contaminated. Each new ladle adds to the problem with the result that contamination of the tundish metal increases with consequent contamination of the cast strand withdrawn from the mould. We have now found that these defects may be minimised by the use of a continuous casting device located beneath a ladle and initially above the upper surface of the contents of a tundish.

According to the present invention there is provided a continuous casting device, for location beneath a ladle nozzle through which a tundish is to be supplied with molten metal, which comprises a hollow body having one or more sidewalls and a heat-destructible base portion having one or more inclined surfaces whereby, when the device is lowered through a layer of slag on the surface metal in a tundish, the slag is deflected away from the base of the device.

It is to be appreciated that the base portion of the device is heat destructible when immersed into the molten metal in the tundish but it is not immediately destroyed on contact with the slag layer on the surface of the tundish metal and accordingly it is capable of deflecting the slag away from the base of the device.

Preferably the device also has means comprising one or more heat-destructible inclined surfaces adapted so as to deflect any anti-skulling material (from the ladle nozzle) striking it when the nozzle is opened.

The deflector means is heat-destructible and as such is destroyed substantially instantaneously when molten metal from the pouring tube strikes it but it is not of course destroyed by the anti-skulling material.

This means may be an upper cover portion. More preferably, the anti-skulling material deflector means comprises an inclined surface of sheet material located above the hollow body portion of the device. In this case the lowermost edge of the inclined surface may terminate at an aperture formed in a side wall of the hollow body portion through which aperture the anti-skulling material may exit. Alternatively the deflector means may comprise a plurality of inclined surfaces the lowermost edges of which may terminate at a plurality of apertures formed in the sidewall or sidewalls of the hollow body of the device. In the latter respect the deflector may be generally conical.

Preferably the base of the device is generally conical and if the upper, cover portion is present that is also preferably generally conical.

The expression generally conical in the context of the present invention includes generally pyramidal.

The device of the present invention may be formed from metal, cardboard, refractory heat-insulating material or ceramic material or a combination of such materials. The thickness of the walls of the device may be from about 0.5 mm to about 50 mm. In the case of metal, mild steel is particularly preferred the thickness of which is preferably about 1 mm to 3 mm. Cardboard carton material may be used to fabricate the device of the invention suitably fireproofed with a refractory coating composition if required. The thickness of cardboard may be from about 2 to 5 mm.

When a refractory, heat-insulating material is used it is preferably used to form the sidewalls of the device. In an embodiment of the present invention the refractory, heat-insulating material may be in the form of a preformed sleeve adapted to be loosely fitting about the outer walls of the hollow body of the device supported by the lower part of the device by means of one or more substantially horizontally disposed ledges. Preferably, the refractory heat-insulating material comprises a proportion of organic and/or inorganic fibre material and binder. The thickness of the refractory, heat-insulating material used to form the sleeve or the sidewalls may be from about 10 to 50 mm preferably 15 to 35 mm. The material may be formed into the sleeve or the sidewalls of the device by any convenient means but generally a slurry forming method is preferred.

In use of a device according to this invention, having a loosely fitting sleeve, the risk of contamination of the continuously cast molten metal by the slag on the surface of the metal contained in a tundish is considerably reduced. This minimisation of slag transfer is achieved because the sleeve floats on the slag layer and prevents slag being entrained into the metal as the device is lowered progressively into the tundish through the sleeve.

This may be more readily achieved by ensuring that the height of the sleeve is equal to or greater than the combined thickness of slag and added anti-skulling material. More preferably however the height of the sleeve is at least equal to or greater than the distance defined between the uppermost edge of the device and the lowermost edge of the pouring tube.

The continuous casting device of the invention may be integrally formed out of one piece of material i.e. pressed or stamped from sheet mild steel or it may be formed from a plurality of separate parts joined together by brazing, rivetting, soldering or welding in the case of metal devices or clipped, stapled or adhesively bonded in the case of cardboard, refractory heat-insulating material or by pressing and firing in the case of devices formed from ceramic material.

In use the device may be rigidly attached to a pouring tube or otherwise held above the ladle impact zone or a tundish e.g. by means of rods, wires or the like.

The invention includes a method of continuously casting a metal in which the device of the invention is used.

The invention is further described with reference to the accompanying diagrammatic drawings in which:

FIG. 1 is a side elevation of a continuous casting device of this invention having a loosely fitting preformed sleeve and showing part of a pouring tube to which the device is rigidly attached.

FIG. 2 is a side elevation of the device of FIG. 1 shown penetrating the slag layer in a tundish.

FIG. 3 is a side elevation of the device showing the ladle nozzle anti-skulling material being deflected.

FIG. 4 is a side elevation of the device showing a stream of molten metal entering the tundish free from contaminants.

FIG. 5 is a side elevation showing the pouring tube immersed in a tundish having gained entry through a slag free zone.

Referring to FIG. 1 a continuous casting device 1 comprises a hollow generally cylindrical body 2 formed of mild steel which is attached to a pouring tube 3 by means of a sleeve 4 by virtue of a press sleeve fit. The body 2 is connected to sleeve 4 by means of three metal tie rods 5 (only two of which are shown). The hollow body 2 has a generally conical base portion 6 defining a ledge 7 which supports a loosely fitting sleeve 8 formed of refractory heat-inslating material. A mild steel inclined plane deflector chute 9 is located above the hollow body 2 and is dimensioned so as to deflect any anti-skulling material, which may strike it in use, away from the device and onto the surface of the slag 10 floating on the surface of the molten steel 12 contained in a tundish (not shown).

In FIG. 2 the generally conical base portion 6 is seen penetrating into the slag layer 10 and being progressively consumed (dotted outline) by the molten steel 12.

In FIG. 3 anti-skulling material 13 is shown leaving the pouring tube 3 and striking the deflector chute 9. The material 13 is deflected onto the slag 10 at a site 14 remote from the device. In addition it is illustrated how the loosely fitting sleeve 8 floats on the slag and prevents build-up of slag 15 from carrying over into the molten steel and also how it defines a slag-free zone.

The aspect of slag carry-over prevention is more clearly shown in FIG. 4 in which molten steel is shown flowing through the tube 3 (the inclined plane deflector chute 9 having been substantially destroyed by the molten steel), through sleeve 8 and the remains of the hollow body 2 (most of which has been consumed by the molten steel) the build-up of slag 15 is prevented from carrying over into the molten steel 12 because the height of the sleeve 8 is greater than the space 16 between the hollow body 2 and the upper sleeve portion 14.

In FIG. 5 the device 1 has been completely consumed (no longer shown) and the lower end of the pouring tube 3 is beneath the surface of the molten slag 10 and steel 12 contained in a tundish (not shown). The refractory heat-insulating sleeve which remained substantially intact to enable the pouring tube to enter the steel 12 without contamination from the slag carry-over has itself now been absorbed into the slag layer 10.

The invention is more particularly described below with reference to the example:

EXAMPLE

A continuous casting device according to the present invention was attached to a ladle pouring tube by means of a friction press sleeve fit prior to the discharge there through of molten steel at a temperature of 1575° C. from the ladle into a continuous casting tundish located beneath the ladle. The ladle, tube and device assembly was slowly lowered towards the tundish which contained molten steel at approx. 1550° C. The upper surface of steel in the tundish was covered by a layer of fluid metallurgical slag.

The conical base of the device parted the fluid slag layer to provide an initial zone free from slag. The conical base was rapidly destroyed by the molten steel beneath the slag but the hollow body remained substantially intact as it as protected by the loosely fitting refractory, heat-insulating sleeve which continued to maintain the slag free zone.

As the assembly continued to be slowly lowered into the tundish, the slide-gate nozzle of the ladle was opened and the anti-skulling material from the ladle nozzle area was released through the bore of the pouring tube. This anti-skulling material was deflected away from the device by the inclined chute located above the hollow body of the device onto the layer of slag.

The anti-skulling material was immediately followed by a stream of molten steel, the initial impact of which on the inclined chute being sufficient to instantly destroy the area of the chute in the metal's path.

The stream of steel entered the tundish through the remains of the device and through the refractory, heat-insulating sleeve which continued to float on the surface of the slag and prevented the build-up of slag held behind the sleeve from entering the steel in the tundish. As the pouring tube was lowered into the tundish steel the sleeve retained integrity sufficiently to prevent any slag from being pushed into steel by the tube.

It was subsequently observed from the results of inclusion tests taken of the steel in the tundish both before and after the addition of the new ladle of molten steel that there had not been any measurable increase in contamination from the new ladle.

We claim:

1. A continuous casting device for location beneath a ladle nozzle through which a tundish is to be supplied with molten metal comprising a hollow body portion having one or more side walls and a heat-destructible base portion having one or more inclined surfaces whereby, when the device is lowered through a layer of slag on the surface of metal in a tundish, the slag is deflected away from the base of the device, and wherein the device further comprises a loosely-fitting preformed sleeve located above said base portion and exteriorly of the sidewalls of the hollow body portion of the device, said sleeve being free to move relative to said sidewalls and floatable on said layer of slag so that as said hollow body portion is lowered through the layer of slag in the tundish, said sleeve defines a slag free zone, thus preventing slag build-up from contaminating said molten metal.

2. A continuous casting device according to claim 1 wherein the base portion of the device is generally conical.

3. A continuous casting device according to claim 1 wherein the device is formed of one or more of a ferrous metal, cardboard, refractory, heat-insulating material or a ceraminc material.

4. A continuous casting device according to claim 1 wherein the device is formed from fire-proofed cardboard carton material.

5. A continuous casting device according to claim 1 wherein the thickness of the material from which the device is formed is in the range of 0.5 mm to 50 mm.

6. A continuous casting device according to claim 1 wherein the device is formed from mild steel.

7. A continuous casting device according to claim 6 wherein the thickness of the mild steel is in the range of 1 mm to 3 mm.

8. A continuous casting device according to claim 1 wherein the device is integrally formed from one piece of material.

9. A continuous casting device according to claim 8 wherein the device is pressed or stamped out of a single sheet of mild steel.

10. A continuous casting device according to claim 1 wherein the device is formed from a plurality of separate parts.

11. A continuous casting device according to claim 10 wherein the plurality of separate parts are joined together by means selected from brazing, rivetting, soldering, welding, clipping, stapling or bonding.

12. A continuous casting device according to claim 1 wherein the device comprises one or more heat-destructible inclined plane surfaces located above the hollow body portion.

13. A continuous casting device according to claim 1 wherein the sleeve is supported by one or more ledges formed on said hollow body portion.

14. A continuous casting device according to claim 1 wherein the sleeve is formed of a refractory, heat-insulating material.

15. A continuous casting device according to claim 14 wherein the refractroy, heat-insulating material comprises particulate refractory material, fibre material and a binder.

16. A continuous casting device according to claim 1 wherein the height of the sleeve is at least equal to or greater than the distance between the uppermost edge of the hollow body portion of the device and the lowermost edge of the pouring tube.

17. A continuous casting device as defined in claim 12 wherein said inclined plane surfaces define chute means for deflecting anti-skulling material from said ladle nozzle away from the base of the device.

18. A continuous casting device for location beneath a ladle nozzle through which a tundish is to be supplied with molten metal comprising a hollow body portion having one or more side walls and a heat-destructible base portion having one or more inclined surfaces whereby, when the device is lowered through a layer of slag on the surface of metal in a tundish, the slag is deflected away from the base of the device; and wherein the device comprises one or more heat-destructible inclined plane surfaces located above the hollow body portion, the lowermost edge of the said one or more inclined plane surfaces terminating at an aperture formed in a side wall of the hollow body portion of the device.

19. A continuous casting device for location beneath a ladle nozzle through which a tundish is to be supplied with molten metal comprising a hollow body portion having one or more side walls and a heat-destructible base portion having one or more inclined surfaces whereby, when the device is lowered through a layer of slag on the surface of metal in a tundish, the slag is deflected away from the base of the device; and wherein the device comprises a plurality of heat-destructible inclined plane surfaces located above the hollow body portion the lowermost edges of said plurality of inclined plane surfaces terminating at a plurality of apertures formed in the one ore more side walls of the hollow body portion of the device.

20. A continuous casting device according to claim 19 wherein the plurality of inclined surfaces are generally conical.

21. A continuous casting device according to claim 20 wherein the generally conical inclined surfaces comprise an upper cover portion of the device.

22. A continuous casting device for location beneath a ladle nozzle through which a tundish is to be supplied with molten metal comprising a hollow body portion having one or more side walls and a heat-destructible base portion having one or more inclined surfaces whereby, when the device is lowered through a layer of slag on the surface of metal in a tundish, the slag is deflected away from the base of the device wherein at least one aperture is formed in a sidewall of the hollow body portion of the device.

23. A continuous casting device as defined in claim 22 wherein a plurality of apertures are formed in one or more sidewalls of the hollow body portion of the device.

24. In a continuous casting method wherein molten metal is supplied to a tundish from a ladle, and wherein the upper surface of molten metal is covered by a layer of metallurgical slag, the steps of:

(a) attaching to the ladle a deflecting device formed with a heat destructible base portion and a loosely fitting sleeve located about sidewalls of said base portion;

(b) lowering the ladle toward the tundish so that the deflecting device deflects slag away from the base of the device to prevent slag from entering the interior of the metal in the tundish as new molten metal is poured therein;

(c) as said base portion is progressively destroyed by said molten metal, continuing to lower said ladle nozzle into the molten metal in the tundish, the loosely fitting sleeve floating on the slag layer and defining a slag free zone in the nozzle area; and (d) pouring new molten metal into the tundish.

25. A method as defined in claim 24 and further including the step of deflecting anti-skulling material preceding the new molten metal away from the ladle nozzle area, and wherein means for deflecting said anti-skulling material is destroyed by the flow of new molten metal.

* * * * *